US005716074A

United States Patent [19]

Theodorou

[11] Patent Number: 5,716,074

[45] Date of Patent: Feb. 10, 1998

[54] MULTI-DIRECTIONAL ROLLER SKATE

[76] Inventor: Katerina Theodorou, 58-51 230th St., Bayside, N.Y. 11364, by Michael Theodorow, guardian

[21] Appl. No.: 627,027

[22] Filed: Apr. 3, 1996

[51] Int. Cl.[6] ..... A63C 1/00

[52] U.S. Cl. ..... 280/843; 280/11.27

[58] Field of Search ..... 280/843, 11.27, 280/11.2, 11.33, 11.22; 293/127

[56] References Cited

U.S. PATENT DOCUMENTS

| | | | |
|---|---|---|---|
| 1,616,442 | 2/1927 | Festenberg et al. | 280/843 |
| 2,330,684 | 10/1943 | Colling | 293/127 |
| 2,445,268 | 7/1948 | Hodgins | 137/104 |
| 3,072,169 | 1/1963 | Hastings | 152/41 |
| 3,170,235 | 2/1965 | Williams | 29/534 |
| 3,757,383 | 9/1973 | Iiyoshi | 16/45 |
| 3,789,947 | 2/1974 | Blumrich | 180/79.3 |
| 3,936,061 | 2/1976 | Wada | 280/11.23 |
| 4,054,335 | 10/1977 | Timmer | 308/191 |
| 4,058,324 | 11/1977 | Dallaire | 280/11.22 |
| 4,070,065 | 1/1978 | Heitfield | 301/5.3 |
| 4,090,283 | 5/1978 | Woolley | 29/159 R |
| 4,208,073 | 6/1980 | Hechinger | 301/5.3 |
| 4,715,460 | 12/1987 | Smith | 180/7.1 |
| 4,909,523 | 3/1990 | Olson | 280/11.2 |
| 5,129,709 | 7/1992 | Klamer | 301/5.3 |
| 5,199,727 | 4/1993 | Lai | 280/11.23 |
| 5,207,454 | 5/1993 | Blackenburg et al. | 280/843 |
| 5,246,238 | 9/1993 | Brown | 280/11.19 |
| 5,259,632 | 11/1993 | Mahoney | 280/7.14 |
| 5,286,043 | 2/1994 | Tkaczyk | 280/11.22 |
| 5,303,940 | 4/1994 | Brandner | 280/11.22 |
| 5,308,152 | 5/1994 | Ho | 301/5.3 |
| 5,310,250 | 5/1994 | Gonsior | 301/5.3 |
| 5,320,417 | 6/1994 | Trosky | 301/5.3 |
| 5,331,752 | 7/1994 | Johnson | 36/115 |
| 5,382,031 | 1/1995 | Marconato | 280/11.22 |
| 5,382,052 | 1/1995 | Tarng | 280/844 |
| 5,388,623 | 2/1995 | Homma | 152/5 |
| 5,393,078 | 2/1995 | Bourdeau | 280/11.22 |
| 5,398,949 | 3/1995 | Tarng | 280/11.22 |
| 5,398,950 | 3/1995 | Tkaczyk | 280/11.23 |
| 5,409,265 | 4/1995 | Douglass | 280/843 |

FOREIGN PATENT DOCUMENTS

| | | | |
|---|---|---|---|
| WO094019073A19/1994 | | WIPO | 280/11.2 |

*Primary Examiner*—Brian L. Johnson
*Assistant Examiner*—Jonathan E. Butts
*Attorney, Agent, or Firm*—Alfred M. Walker; Harvey Lunefeld

[57] ABSTRACT

A in-line roller skate has spherical roller wheels with multi-directional turning ability. The skate has the ability of both forward and rearward movement, but can also slide sideways in lateral and angular directions, in a similar manner to a figure skating ice skate. The roller skate achieves the versatility of movement of figure skating ice skates. The skates include a single line of spherical shaped wheels, which substitute for the single axis wheels of a roller skate. The roller skate can slide sideways. In use, the roller skate provides a skater with multi-directional movement, such as forward and rearward movement by the rotation of roller wheels in any direction. Because of the multi-directional movement of the spherical roller wheels, the skater can rotate and spin about a vertical axis like an ice figure skater, as well as slide sideways.

19 Claims, 4 Drawing Sheets

MULTI-DIRECTIONAL ROLLER SKATE

The present invention relates to an in-line roller skate with multi-directional turning ability. The skate has the ability of both forward and rearward movement, but can also slide sideways.

BACKGROUND OF THE INVENTION

Roller skates have been known for many years. However, roller skates do not achieve the versatility of movement of figure skating ice skates. For example, while figure skating ice skates can move both in a forward and rearward manner, they can also rotate upon the ice to allow the figure skater to achieve graceful and stunning spinning moves.

Common roller skates, on the other hand, can only move in a straight line, either forward or backward. However, because of the usual configuration of two pairs of front and rear wheels, roller skates cannot rotate and spin like figure skating ice skates. In addition, because each pair of wheels contains two wheels which are spaced apart from each other, it is difficult for a roller skater to lean left or right, such as while pivoting about a single ice skate blade, which can only pivot in one plane, either left or right off of a vertical line.

An attempt to improve the versatility of roller skates was achieved with the introduction of ROLLER BLADES, which comprise a single line of generally rounded cylindrical or toroid shaped wheels, which substitute for the blade of an ice skate.

Because the roller wheels are provided one in front of each other in a single line, left or right pivoting is achievable. Therefore, a user ROLLER BLADES can attempt to achieve the left or right leaning motions of an ice skater, which enhances speed and maneuverability better than with a common roller skate, especially when moving around a curve.

However, because the wheels turn about an invisible horizontal axis, the ROLLER BLADES cannot rotate and spin like ice skates.

Furthermore, even ice figure skates can only rotate and spin, but they cannot slide sideways in a direction perpendicular to the axis of the blade of the ice skate.

Therefore, there is a need for a personal skate which not only can move forward and rearward like roller skates, ROLLER BLADES and ice skates, but also there is a need for a personal skate which can rotate and spin like ice skates.

Moreover, there is a further need for a personal skate which can also move sideways, a feature which is not achievable any of the existing skates, including roller skates, ROLLER BLADES or ice skates.

Most wheels can only turn in one plane, since the wheels rotate about a single axis. The skates which have a set of roller wheels set within the periphery of wheels are limited to forward and lateral motion only, and the vector addition of the two does not add up to smooth omni-directional motion.

Among the prior art patents for wheels which rotate about a single axis include U.S. Pat. No. 2,445,268 of Hodgins which describes a float; U.S. Pat. No. 3,072,169 of Hastings which describes a resilient wheel; U.S. Pat. No. 3,170,235 of Williams which describes a method of fabricating a connecting device about a single axis; U.S. Pat. No. 3,757,383 of Iiyoshi which describes hollow sphere-like structures and U.S. Pat. No. 3,789,947 of Blumrich shows an omni-directional wheel.

U.S. Pat. No. 3,936,061 of Wada shows a roller skate with wheels having a single axis about which axis the wheels rotate and U.S. Pat. No. 4,054,335 of Timmer which shows a castor wheel. U.S. Pat. No. 4,058,324 of Dallaire describes an early version of a ROLLER BLADE roller skate with maneuverability adjustments and U.S. Pat. No. 4,070,065 of Heitfield describes a wheel for skateboards and roller skates.

U.S. Pat. No. 4,090,283 of Woolley describes a method of making hollow globular roller but the globular roller rotates about a single axis.

U.S. Pat. No. 4,208,073 of Hechinger shows a wheel for skateboards and roller skates and U.S. Pat. No. 4,715,460 of Smith shows a wheelchair base with single axis wheels having bearings in the circumferential periphery thereof. The bearings rotate perpendicular to the plane of each wheel, so that the wheels can move laterally. However, the wheels are limited to forward and lateral movement at a direction roughly perpendicular to the forward movement, but not at any angular movement at angles between 0 and 90 degrees off of the forward direction.

U.S. Pat. No. 5,129,709 of Klamer describes a single axis wheel for roller skate and the like and U.S. Pat. No. 5,199,727 of Lai describes a steerable wheel assembly with single axis wheels with bearings therein for a roller skate.

U.S. Pat. No. 5,246,238 of Brown shows a single axis roller skate wheel with a plurality of further single axis bearings along its periphery, which rollers rotate perpendicular to the plane of the wheel, so that the skate can move in the forward and lateral directions. However, the skate in Brown '238 moves laterally for braking purposes.

U.S. Pat. No. 5,259,632 of Mahoney describes a skateboard adapted for use on ice with rotating thin cylindrical blades; U.S. Pat. No. 5,286,043 of Tkaczyk shows an in-line roller skate with single axis wheels; U.S. Pat. No. 5,303,940 of Brandner describes a skate having angularly mounted single axis wheels; U.S. Pat. No. 5,308,152 of Ho shows a single axis wheel unit for an in-line roller skate and U.S. Pat. No. 5,320,417 of Trosky shows a roller skating wheel.

U.S. Pat. No. 5,310,250 of Gonsior shows a single axis in-line ROLLER BLADE skate wheels and U.S. Pat. No. 5,331,752 of Johnson describes a ROLLER BLADE skate with a detachable shoe. U.S. Pat. No. 5,382,031 of Marconato describes a ROLLER BLADE skate with improved steering capabilities wherein the single axis wheels can also slide sideways along the axle left or right while rolling forward or rearward. U.S. Pat. No. 5,382,052 of Tarng shows an in-line ROLLER BLADE figure skate with a beaded continuous belt moving around single axis wheels and U.S. Pat. No. 5,398,949, also of Tarng, describes a similar figure blade roller skate. U.S. Pat. No. 5,388,623 of Homma describes elastic single axis wheels and a pair of skis provided with the elastic wheels and U.S. Pat. No. 5,393,078 of Bourdeau shows a skate with in-line single axis wheels.

Moreover, U.S. Pat. No. 5,398,950 of Tkaczyk describes an interchangeable roller skate, also with single axis wheels.

Therefore, none of the prior art patents are able to provide an axle-less wheel. All of the single axis wheels can only rotate in one plane, except for the complicated devices with further, complicated single bearings built into the circumference of the larger single axis wheel. Furthermore, upon information and belief, no other known roller skate has a spherical roller, thereby providing the skater the ability to move effectively, smoothly and easily in any angular direction from 0 to 360 degrees relative to the forward direction.

OBJECTS OF THE INVENTION

It is therefore an object of the present invention to provide an in-line roller skate with multi-directional turning ability.

It is yet another object to provide a skate which has the ability of both forward and rearward movement, but can also slide sideways in a similar manner to a figure skating ice skate.

It is a further object to provide a roller skate which achieves the versatility of movement of figure skating ice skates.

It is yet another object to provide a roller skate which allows the figure skater to achieve graceful and stunning spinning moves.

It is yet another object to provide a roller skate which enables a roller skate to lean left or right with ease.

It is yet another object to provide a roller skate which enhances speed and maneuverability better than with a common roller skate, especially when moving around a curve.

It is yet another object to provide a personal roller skate which not only can move forward and rearward like roller skates, ROLLER BLADES and ice skates, but also there is a need for a personal skate which can rotate and spin like ice skates.

It is yet another object to provide a roller skate which improves over the disadvantages of the prior art.

SUMMARY OF THE INVENTION

In keeping with these objects and others, which may become apparent, the present invention relates to an in-line roller skate which multi-directional turning ability. The skate has the ability of both forward and rearward movement, but can also slide sideways in a similar manner to a figure skating ice skate. Moreover, the skate has the ability to move in any angular direction from 0 to 360 degrees relative to the forward direction.

The roller skate includes an upper boot portion attached to a top edge of a chassis. The chassis is a generally hollow structural member having a curved exterior wall which is narrower at the top edge than at the bottom edge. The chassis is above a roller wheel compartment, which is also a generally hollow structural member which is hinged and openable to gain access to a hollow interior containing a plurality of roller wheel housings. The roller wheel housings contain portions of spherical roller wheels, which spherical roller wheels extend down to the ground and rotate in all directions. The spherical wheels are held in place by the descending lower wall portion of the compartment.

Each spherical roller wheel rotates about a plurality of ball bearings within the roller wheel housings, wherein three or more ball bearings are provided in a fork shape configuration.

The ball bearings in turn each rotate within ball bearing housings, which are shaped concave in a generally concave hemispherical shape to accommodate rotation of the ball bearings therein.

The ball bearings are held within the ball bearing housings by a removable curved retaining plate, which is placed under the ball bearings, so that only a lower portion of ball bearings extends the below curved retaining plate. Therefore, to clean and service the ball bearings and the interior of the ball bearing housing, the retaining plate is removed, thereby exposing the entire ball bearings and the interior of ball bearing housing.

To facilitate the proper rotation of the roller wheels against the plurality of ball bearings placed at an upper portion of the roller wheels, an additional plurality of smaller ball bearings are provided equidistantly spaced apart from each other in a horizontal plane substantially equal to an equator midline of the roller wheel.

The smaller ball bearings rotate within smaller ball bearing housings which are attached to the descending walls of the roller wheel housings. The smaller ball bearings are also held in place by a curved retaining plate within the small ball bearing housings, which are located within the lower ends of the descending walls of the roller wheel housings.

To open and close the hollow compartment with the roller wheel housings from the chassis, a hinge includes a plurality of hollow sleeves which are provided on both sides of the hollow compartment. The sleeves are provided in alternate spaced arrangement on opposite sides of the compartment.

Therefore, the sleeves collectively form two combined sleeves to accommodate bolts therein. The bolts are insertable within the chassis.

When either bolt is removed from its respective sleeves, then the remaining bolt acts as a hinge to open the chassis from the compartment for cleaning and servicing of the roller wheels, as well as the roller wheel housings.

For safety, to prevent a skater from hitting obstructions in front of the skate, an elevated impact wheel is provided at the front end of the roller skate. Since the impact wheel is elevated, it does not interfere with the normal operation of the roller skate.

To stop the roller skate, an elevated brake, such as a rubber sphere, is provided at the rear of the chassis and the roller wheel housing compartment. Also, since the brake is elevated, it is only activated when a skater lowers the heel portion of the skate.

For further impact protection, a preferably padded band brake encircles the chassis at a lower end thereof, for side movement braking. Preferably, the band brake stretches around the chassis, and can be removed after wear and tear.

In use, the roller skate of the present invention provides a skater with multidirectional movement, such as forward and rearward movement by the rotation of the spherical roller wheels in any direction.

Because of the multi-directional movement of the spherical roller wheels with roller wheel housings, the roller skater can skate like an ice figure skater, and can also slide laterally sideways perpendicular to forward movement, or at an angle between 0 and 90 degrees between forward and lateral sideways movement.

DESCRIPTION OF THE DRAWINGS

The present invention can best be understood in conjunction with the accompanying drawings, in which.

DETAILED DESCRIPTION OF THE PREFERRED EMBODIMENTS

FIGS. 1–5 describe a first embodiment of the novel in-line roller skate 1 of the present invention. In-line skate 1 includes upper boot portion 10 attached at a lower edge 10*a* to top edge 12*a* of chassis 12. Chassis 12 is a generally hollow structural member having a curved exterior wall which is narrower at the top edge 12*a* than at the bottom edge 12*b*.

Figure 1:
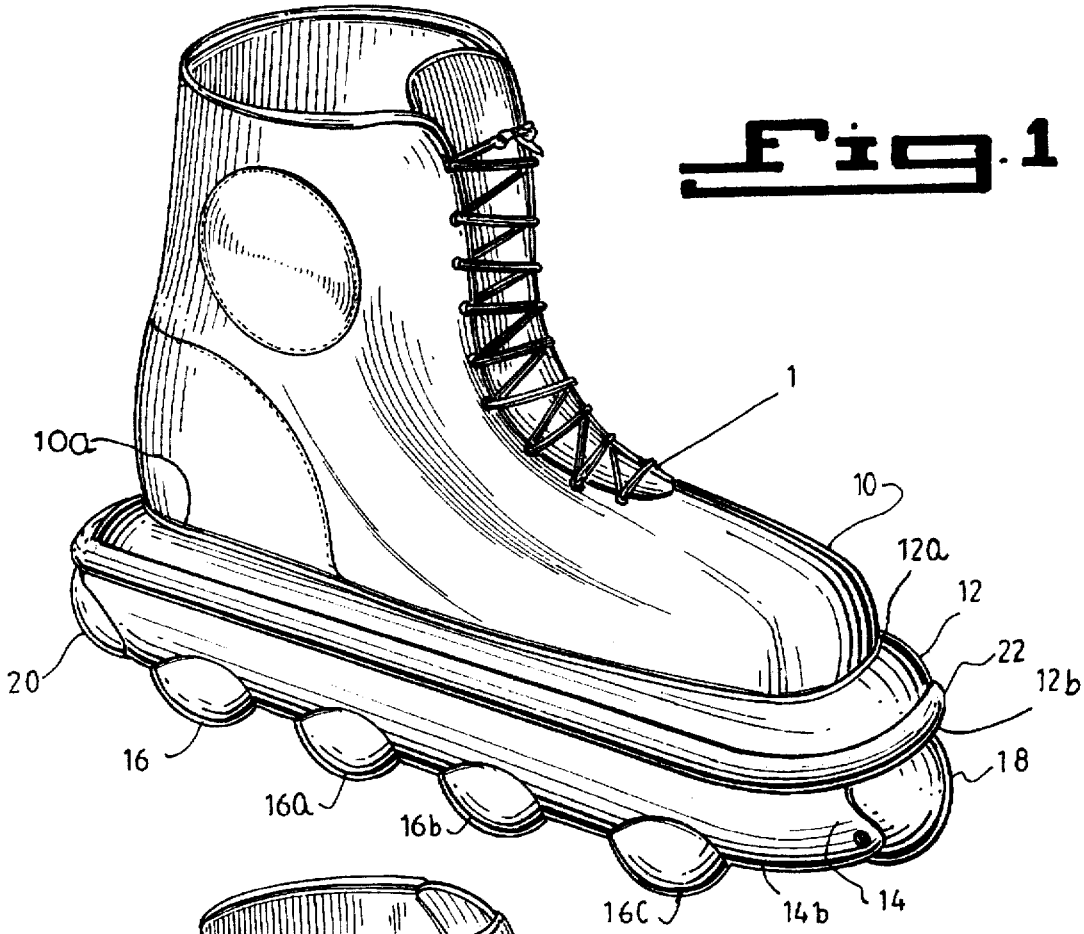
FIG. 1 is a perspective view from the left front of the in-line roller skate footwear of the present invention.
Figure 2:
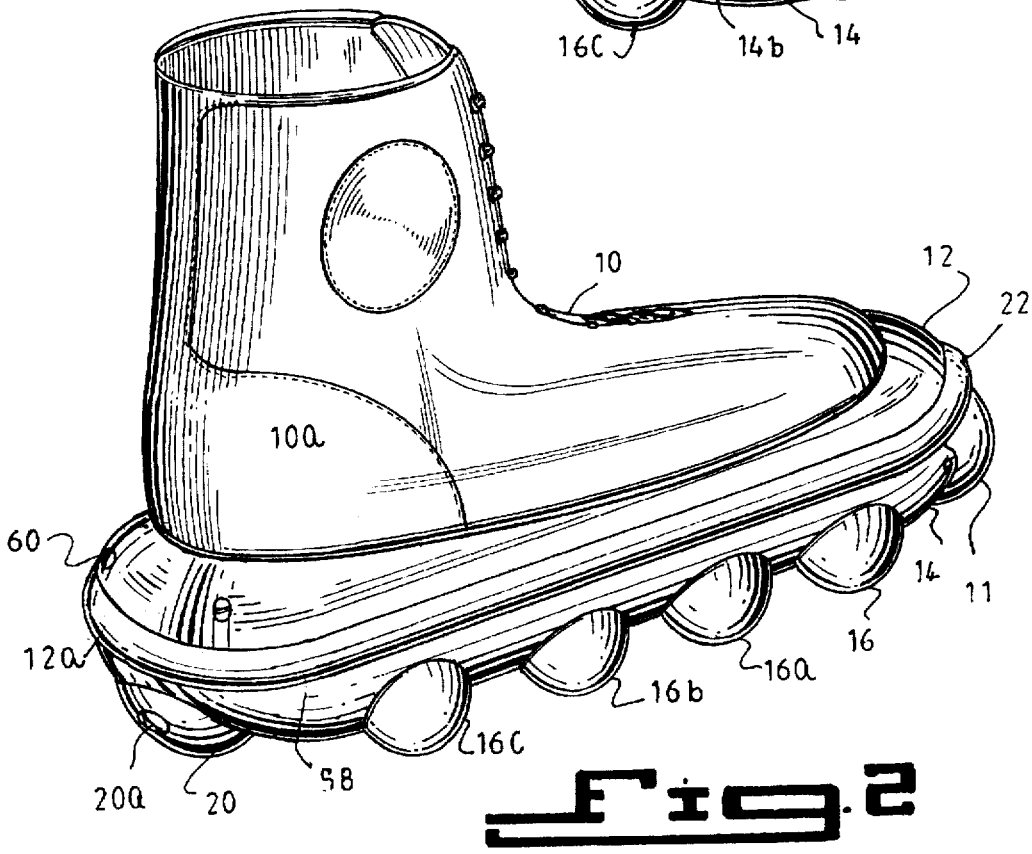
FIG. 2 is a further perspective view from the right rear of the in-line roller skate footwear as in FIG. 1.
Figures 3, 3A:
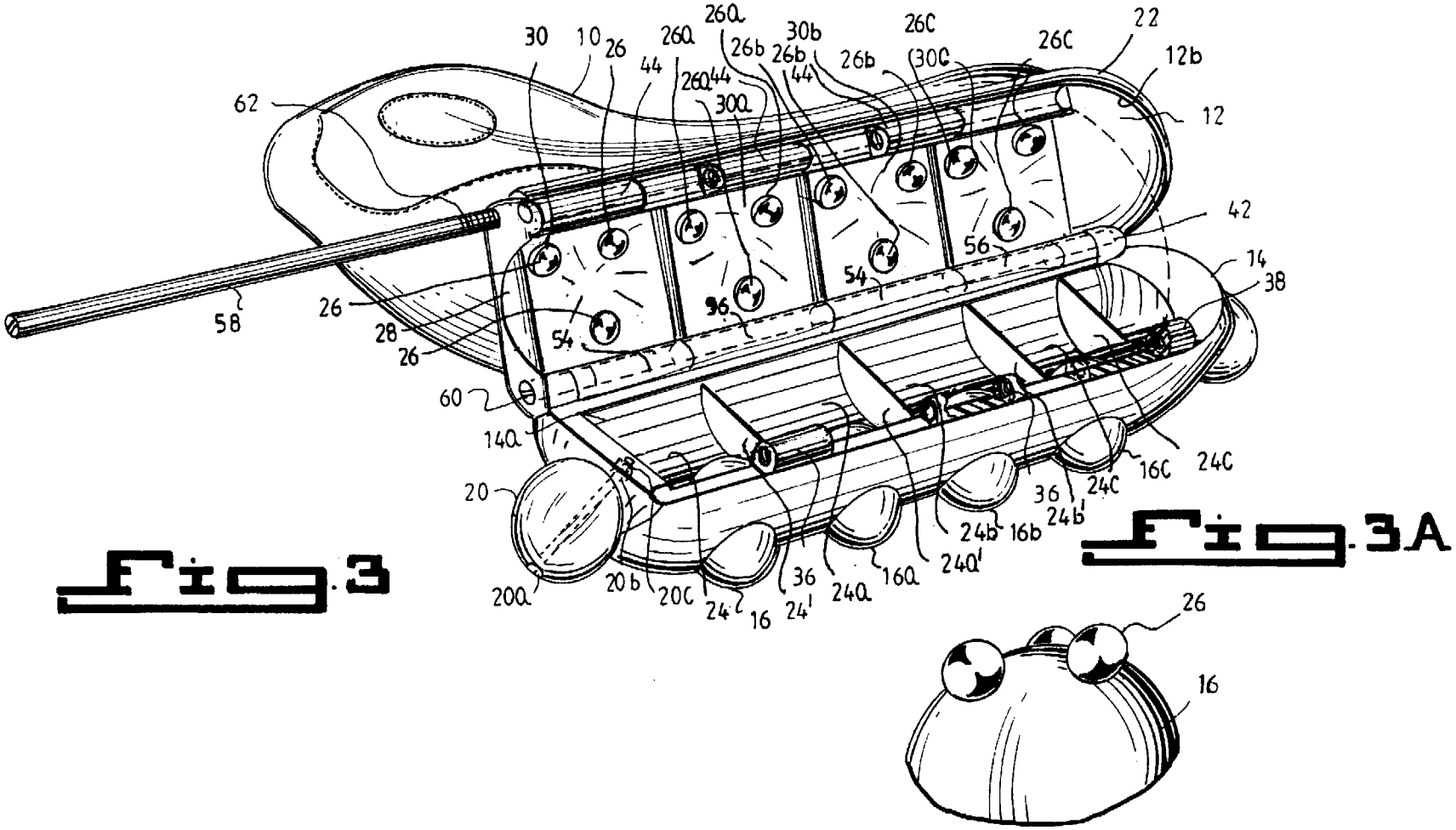
FIG. 3 is a bottom perspective view of the in-line roller skate footwear as in FIG. 1, shown with the roller accommodating chassis portion in an open position.
FIG. 3A is a close-up perspective view of the bearing accommodating portion of a roller of the in-line roller skate footwear as in FIG. 1.

As shown in FIG. 3, roller wheel compartment 14 is also a generally hollow structural member which is hinged and openable to gain access to hollow interior 14*a* containing a plurality of roller wheel housings 24, 24*a*, 24*b*, 24*c*, etc, which are separated from each other by respective walls 24, 24*a*, 24*b*, 24*c* within compartment 14.

As further shown in FIG. 3, roller wheel housings 24, 24*a*, 24*b*, 24*c*, etc. contain portions of spherical roller wheels 16, 16*a*, 16*b*, 16*c*, etc.

Figure 4A:
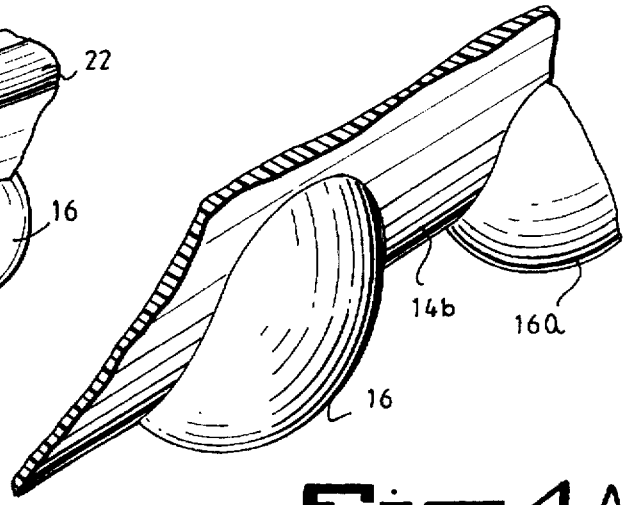
FIG. 4A is a close-up perspective view of a portion of the in-line roller skate footwear as in FIG. 1, showing two of the rollers therein.
Figure 4:
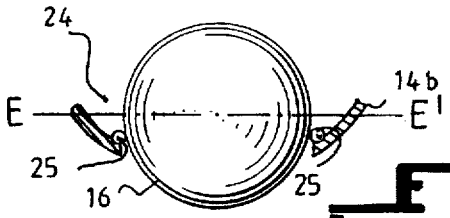
FIG. 4 is a close-up front view of a roller of the in-line roller skate footwear as in FIG. 1.

As shown in FIG. 4, spherical roller wheel 16 is held in place within roller wheel housing 24 by lower bearings 25 adjacent to descending lower wall portion 14*b* of compartment 14. Lower bearings 25 are placed below equatorial plane E–E' of roller 16.

Likewise, spherical roller wheels 16*a*, 16*b*, 16*c* are similarly held in place within respective roller wheel housings 24*a*, 24*b*, 24*c* by lower bearings similar to roller bearings 25.

As shown in FIG. 3A, spherical roller wheel 16 rotates about plurality of ball bearings 26 within roller wheel housing 24, wherein three or more ball bearings 26 are provided in an equidistant forked shape configuration.

Figure 5:
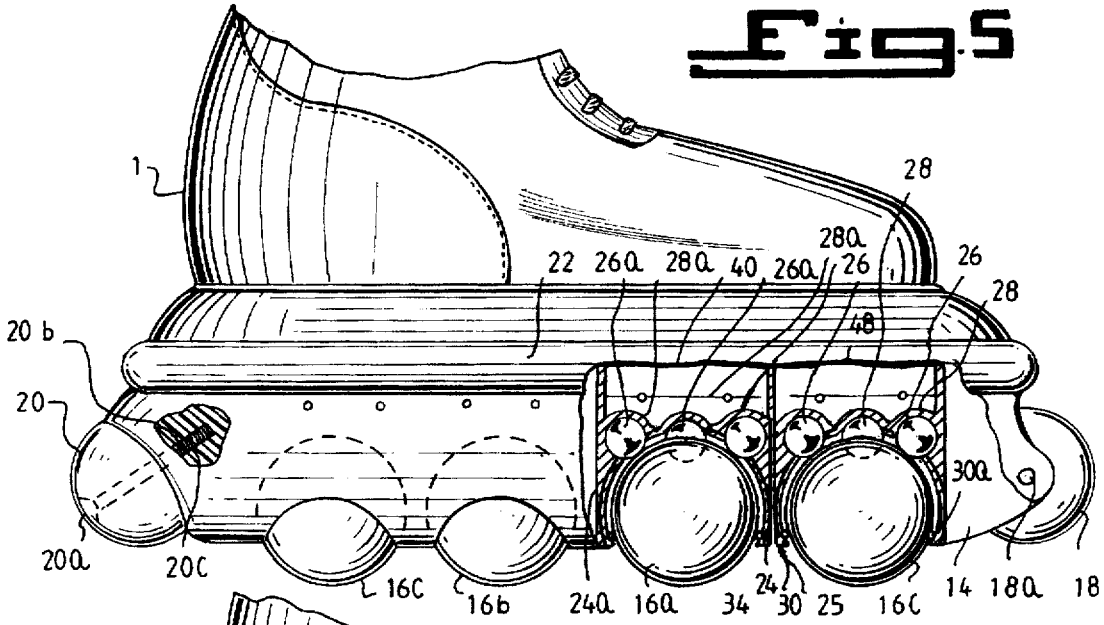
FIG. 5 is a right side elevational view in partial section of the in-line roller skate footwear as in FIG. 1.

As shown in FIG. 5, with respect to roller wheel 16*c*, ball bearings 26*c* in turn each rotate within ball bearing housing 28*c*, which housings 28*c* are shaped concave in a generally concave hemispherical shape to accommodate rotation of ball bearings 26*c* therein.

With respect to roller wheel 16*b*, ball bearings 26*b* in turn each also rotate within ball bearing housings 28*b*, which housings 28*b* are shaped concave in a generally concave hemispherical shape to accommodate rotation of ball bearings 26*b* therein.

Furthermore, concerning roller wheel 16 and 16*a*, respective ball bearings 26, 26*a* in turn each also rotate within ball bearing housings (not shown) similar to respective ball bearing housings 28*b* or 28*c*, which housings are also shaped concave in a generally concave hemispherical shape to accommodate rotation of respective ball bearings 26, 26*a* therein.

As also shown in FIGS. 3 and 5, to maintain ball bearings 26*c* within ball bearing housings 28*c*, removable curved retaining plate 30*c* is placed under ball bearings 26*c*, so that only a lower portion of ball bearings 26*c* extends below curved retaining plate 30*c*. For cleaning and servicing ball bearings 26*c* and the interior of ball bearing housing 28*c*, retaining plate 30*c* is removed, thereby exposing the entire ball bearings 26*c* and the interior of ball bearing housing 28*c*.

As further shown in FIGS. 3 and 5, to also maintain ball bearings 26*b* within ball bearing housings 28*b*, removable curved retaining plate 30*b* is placed under ball bearings 26*b*, so that only a lower portion of ball bearings 26*b* extends below curved retaining plate 30*b*. Retaining plate 30*c* is also removable to expose the entire ball bearings 26*b* and the interior of ball bearing housing 28*b*.

As shown in FIG. 5, to also maintain respective ball bearings 26, 26*a* within ball bearing housings (not shown), removable curved retaining plates 30, 30*a* are placed under respective ball bearings 26 or 26*a*, so that only the lower portions of ball bearings 26, 26*a* extends below respective curved retaining plates 30, 30*a*. Retaining plates 30, 30*a* are also removable to expose the entire ball bearings 26, 26*a* and the interior of the respective ball bearing housings (not shown) within which respective ball bearings 26, 26*a* rotate.

To facilitate the proper rotation of roller wheel 16 against the plurality of ball bearings 26 at an upper portion of roller wheel 16, an additional plurality of smaller ball bearings 25 are provided equidistantly spaced apart from each other in a horizontal plane below an equatorial plane of roller wheel 16.

Smaller ball bearings 25 rotate within smaller ball bearing housings 34 attached to descending walls 46, 48 of roller wheel housing 24. Smaller ball bearings 25 are held in place by retaining plate 30 within small ball bearing housings 34 within lower ends 50, 52 of respective descending walls 46, 48 of roller wheel housing 24.

With respect to second roller wheel 16*a*, corresponding smaller ball bearings 25 are provided equidistantly spaced apart from each other in a horizontal plane substantially equal to an equatorial plane of roller wheel 16*a*.

Smaller ball bearings 25 also rotate within smaller ball bearing housings 34*a* attached to descending walls 46*a*, 48*a* of roller wheel housing 24*a*. Smaller ball bearings 25 are held in place by retaining plate 30*a* within small ball bearing housings 34*a* within lower ends 50*a*, 52*a* of respective descending walls 46*a*, 48*a* of corresponding roller wheel housing 24*a*.

To open and close compartment 14 from chassis 12, hinge means 42 includes a plurality of sleeves 36 are provided on one side of compartment 14. A further plurality of sleeves 54 are provided in alternate spaced arrangement on an opposite side of compartment 14. Moreover, a similar set of sleeves 44 are provided on one side of chassis 12 which matches with the side of compartment 14 having sleeves 36. A further set of sleeves 56 are provided in an alternate spaced arrangement on an opposite side of chassis 12 which matches with the side of compartment 14 having sleeves 54 thereat.

Therefore sleeves 36, 44 meet longitudinally to form a combined sleeve to accommodate bolt 58 therein. Likewise, sleeves 54, 56 meet longitudinally to form a combined sleeve to accommodate second bolt 60 therein. Bolts 58, 60 are insertable within rear plate 12*a* of chassis 12.

Threaded ends 62 of bolts 58, 60 are threadable within further threaded receptacles 38, 42 at the front end of compartment 14.

When either bolt 58 or 60 is removed from its respective sleeves, then the remaining bolt 58 or 60 acts as a hinge to open chassis 12 from compartment 14 for cleaning and servicing of roller wheels 16, 16*a*, 16*b*, 16*c*, etc, as well as roller wheel housings 24, 24*a*. etc.

Figure 5A:
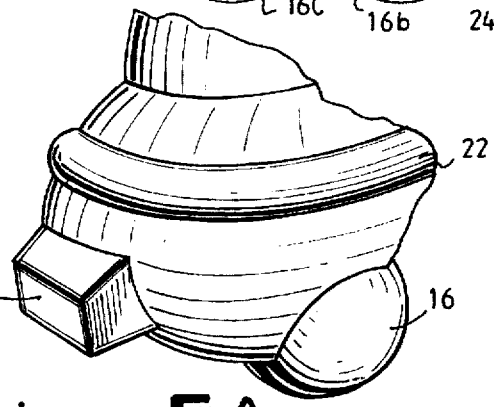
FIG. 5A is a close-up rear perspective view in partial section of an alternate embodimenta roller of the rear of the roller skate footwear as in FIG. 1; and, FIG. 6 is a side elevational view in partial cross section of an alternate embodiment for a roller skate of the present invention.

To prevent a skater from hitting obstructions, elevated impact wheel 18 is provided at the front end of skate 1. Impact wheel 18 is held in place by axle 18*a* attached to a front end of compartment 14. Since impact wheel 18 is elevated, it does not interfere with the normal operation of skate 1. For further protection, as shown in FIG. 5 and FIG. 5A, an elevated brake, such as sphere 20 or box 20', is provided at the rear of compartment 14. Also, since brake 20 is elevated, it is only activated when a skater lowers the heel portion of skate 1. Brake 20 or brake 20' are held in place preferably by a fastener, such as rod 20*a*, which includes a threaded end 20*b* threadable within threaded receptacle 20*c* of compartment 14.

Finally, for extra protection, band brake 22 encircles chassis 12 at lower end 12*b* thereof, for side movement braking. Preferably, band brake 22 is elastomeric, so that it can be stretches around chassis 12, and removed after wear and tear.

In use, skate 1 provides a skater with multidirectional movement, such as forward and rearward movement by the rotation of roller wheels 16 in any direction. Unencumbered by wheels to either side of spherical roller wheels 16, spherical roller wheels 16 facilitate the pivotable leaning left and right off of a vertical axis.

Most importantly, because of the multi-directional movement of spherical roller wheels 16, 16*a*, 16*c*, etc. with roller wheel housings 24, 24*a*, etc., the skater can rotate and spin about a vertical axis like an ice figure skater, but can also slide sideways, a movement not achievable in any kind of prior art skate.

Figure 6:
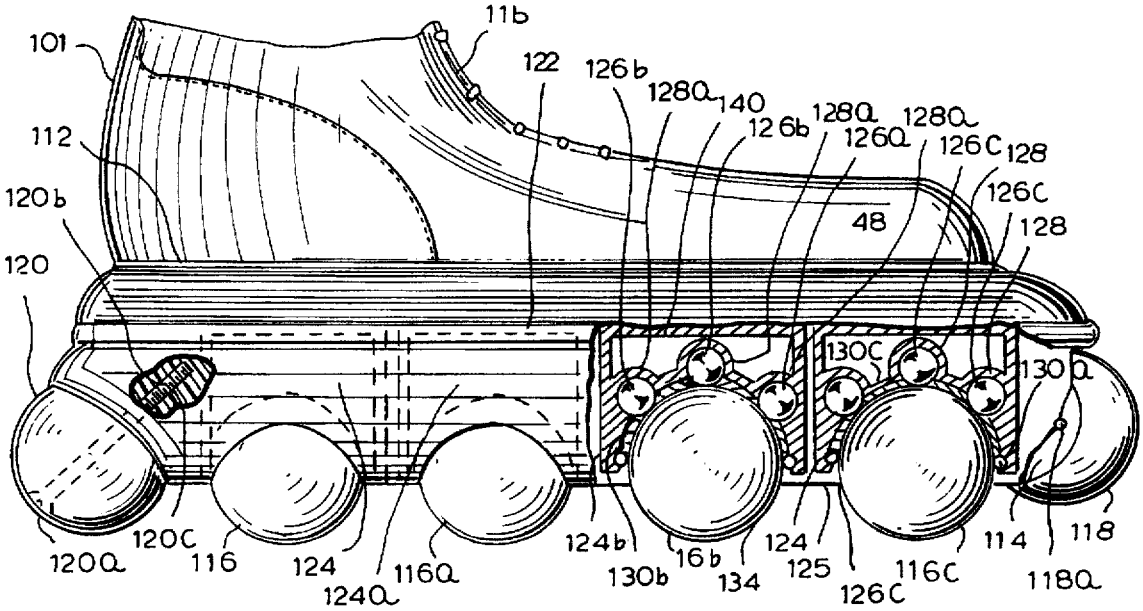

While the embodiment shown in FIGS. 1, 2, 3 and 5 shows roller wheel housings 24, 24*a*, 24*b*, 24*c* to be integral with compartment 14, separated from each other only by walls 24', 24*a*', 24*b*', 24*c*', in the alternate embodiment shown in FIG. 6, roller skate boot portion 110 is attached to chassis 112 above lower compartment 114.

As further shown in FIG. 6, roller wheels 116, 116*a*, 116*b*, 116*c* rotate within removable modular roller wheel housings roller wheel housings 124, 124*a*, 124*b*, 124*c*, generally including walls 48.

To maintain rotation, as shown in FIG. 6, roller wheel 116*c* rotates against plurality of roller bearings 126*c*, which rotate themselves within bearing housings 128*c*, and roller bearings 126*c* are held in place by concave plate 130*c*. Likewise, roller wheel 116*b* rotates against plurality of roller bearings 126*b*, which rotate themselves within bearing housings 128*b*, and roller bearings 126*b* are held in place by concave plate 130*b*.

While the embodiment shown in FIGS. 1–5 shows three ball bearings 26 placed in an equidistant forked configuration at the top of roller wheel 16, wherein ball bearings 26 are in the same horizontal plane, in the alternate embodiment shown in FIG. 6, ball bearings 126*b* or 126*c* may have more than three per roller wheel, so ball bearings 126*b* or 126*c* do not have to be placed in the same horizontal plane as ball bearings 26 in FIGS. 1–5.

As also shown in FIG. 6, elevated impact wheel 118 is provided at the front end of skate 101. Impact wheel 118 is held in place by axle 118*a* attached to a front end of compartment 114. Elevated brake 120, such as a rubber sphere, is provided at the rear of compartment 114. Brake 120 is held in place preferably by attachment rod 120*a*, which includes a threaded end 120*b* threadable within threaded receptacle 120*c* of compartment 114. Moreover, band brake 122 encircles chassis 112 at lower end 112*b* thereof, for side movement braking.

In summary, multidirectional roller skate 1 includes a means for affixing roller skate 1 to a foot. Housing 24 is adjoined to the foot affixing means, wherein housing 24 has at least one concave region. At least one spherical roller 16 is provided for rollably interfacing between the concave region and a surface onto which multidirectional roller skate 1 imparts multidirectional movement, such as a floor.

Spherical roller 16 is held within housing 24, such that a portion of spherical roller 16 protrudes from housing 16, thereby allowing contact between spherical roller 16 and the floor surface.

In one embodiment, multidirectional roller skate 1 also includes a plurality of housings 24, 24*a*, 24*b*, 24*c*, etc. each having concave regions therein, each housing 24, 24*a*, 24*b*, 24*c*, etc. having a plurality of ball bearings 26, 26*a*, 26*b* or 26*c*, etc. for rollably interfacing between housings 24, 24*a*, 24*b*, 24*c*, etc. and respective spherical rollers 16, 16*a*, 16*b*, 16*c* etc.

Each spherical roller 16 rollably interfaces between ball bearings 26 and the floor surface onto which multidirectional roller skate 1 imparts multidirectional movement. Each spherical roller 16 is held within respective housings 24, such that a portion of spherical roller 16 protrudes from housing 24, thereby allowing contact between spherical roller 16 and the floor surface.

Preferably, multidirectional roller skate 1 includes a shoe 10 for affixing multidirectional roller skate 1 to a foot.

Chassis 12 is adjoined to shoe 10, and has at least one hollow underside region, a hollow toe region, and a hollow heel region.

A plurality of concave regions are provided in said chassis, so that plurality of ball bearings 26 move in each of the concave regions of housings 24 for rollably interfacing between the concave regions and spherical roller 16 in each of housings 24.

Spherical roller 16 rolls in each said hollow concave region of housing 24, and rollably interfaces between ball bearings 26 in each of the concave regions of housing 24 and a floor surface onto which multidirectional roller skate 1 imparts multidirectional movement. Spherical roller 16 is held within housing 24, such that a portion of each spherical roller 16 protrudes from housing 24, thereby allowing contact between spherical roller 16 and the floor surface upon which skate 1 imparts multidirectional movement.

It is further known that other modifications may be made to the multi-directional skate of the present invention, without departing from the scope of the invention, as described in the appended claims.

I claim:

1. A multidirectional roller skate, comprising:

means for affixing said multidirectional roller skate to a foot;

a housing adjoined to said foot affixing means, said housing having at least one concave region therein;

said housing having a first upper compartment having a hollow toe region and a hollow heel region therein, said housing having a second lower compartment having hollow underside region below said first compartment;

at least one spherical roller for rollably interfacing between said concave region and a surface onto which said multidirectional roller skate is imparted multidirectional movement;

means for holding said at least one spherical roller within said housing, such that a portion of said spherical roller protrudes from said housing, thereby allowing contact between said at least one spherical roller and said surface; and, a hinge means to open and close said housing, said hinge means joining said first upper compartment to said second lower compartment along a common edge therebetween.

2. The multi-directional roller skate as in claim 1 further comprising at least one elevational impact brake member provided at least one end thereof.

3. The multi-directional roller skate as in claim 1 further comprising a band brake encircling said skate at a lower end thereof for side movement braking.

4. A multidirectional roller skate, comprising:

means for affixing said multidirectional roller skate to a foot;

a housing having a first upper compartment enclosing a hollow toe region and a hollow heel region therein;

said housing having a second lower compartment enclosing a hollow underside region below said first compartment;

said housing adjoined to said foot affixing means said hollow underside region having a plurality of concave regions;

a plurality of ball bearings for rollably interfacing between said concave regions and at least one spherical roller, said spherical roller for rollably interfaces between said ball bearings and a surface onto which said multidirectional roller skate is imparted multidirectional movement; and means for holding said spherical roller within said housing, such that a portion of said spherical roller protrudes from said housing, thereby allowing contact between said spherical roller and said surface; and, a hinge means to open and close said housing, said hinge means joining said first upper compartment to said second lower compartment along a common edge therebetween.

5. The multi-directional roller skate as in claim 4 further comprising at least one elevational impact brake member provided at least one end thereof.

6. The multi-directional roller skate as in claim 4 further comprising a band brake encircling said skate at a lower end thereof for side movement braking.

7. A multidirectional roller skate, comprising:

a shoe for affixing said multidirectional roller skate to a foot;

a housing adjoined to said shoe having at least one hollow underside region, a hollow toe region, and a hollow heel region;

a plurality of concave regions in each said hollow underside region, hollow toe region, and a hollow heel region;

a plurality of ball bearings in each of said concave regions of said housing for rollably interfacing between said concave regions and a spherical roller in each of said housing hollow regions, said spherical roller rolls in each said hollow region of said housing for rollably interfacing between said plurality of ball bearings in each of said concave regions and a surface onto which said multidirectional roller skate is imparted multidirectional movement;

means for holding said spherical rollers within said housing, such that a portion of each said spherical roller protrudes from said housing, thereby allowing contact between said spherical rollers and said surface, a hinge means to open and close said housing, said hinge means including a first set of plurality of sleeves provided on one side of a first compartment within said housing and a second plurality of sleeves are provided in alternate spaced arrangement on an opposite side of said first compartment, and a third set of a plurality of sleeves provided on one side of a further compartment, which said further compartment matches with said side of said first compartment having said first set of sleeves, and a fourth set of sleeves are provided in an alternate spaced arrangement on an opposite side of said further compartment, said further compartment matching with the side of said first compartment having said second set of sleeves thereat, wherein said first and second set of sleeves meet longitudinally to form a combined sleeve to accommodate a first bolt therein and said third and forth set of sleeves meet longitudinally to form a further combined sleeve to accommodate a second bolt therein.

8. The multi-directional skate as in claim 7 wherein said ball bearings are configured in triangular configurations about said rollers.

9. The multi-directional skate as in claim 8 wherein said triangular configurations comprise at least two triangular configurations of said ball bearings about said rollers.

10. The multi-directional skate as in claim 9 wherein said triangular configurations of said ball bearings comprise an upper set of ball bearings for providing load bearing interfaces between said concave regions and said spherical rollers and for providing multidirectional movement capability and a lower set of ball bearings for lateral retention of said rollers within said concave regions, said lower set of ball bearings placed within a plane below an equator of each of said rollers.

11. The multi-directional roller skate as in claim 10 further comprising said upper ball bearings and said lower ball bearings being retained and supported within said concave region by a removable curved retaining plate, wherein only a portion of said ball bearings extends beyond said curved retaining plate.

12. The multi-directional roller skate as in claim 7 wherein said bolts are insertable within a rear plate of said chassis.

13. The multi-directional roller skate as in claim 12 wherein said first and said second bolts each have threaded ends, which said threaded ends of said bolts are threadable within further threaded receptacles at the front end of said compartment, wherein when either bolt is removed from its respective sets of sleeves, then said remaining bolt act as a hinge to open said second compartment from said first compartment for cleaning and servicing of said roller wheels and said roller wheel housing.

14. The multi-directional roller skate as in claim 7 further comprising an elevated impact wheel provided at a front end of said roller skate.

15. The multi-directional roller skate as in claim 14 wherein said impact wheel is held in place by an axle attached to a front end of said compartment.

16. The multi-directional roller skate as in claim 15 wherein said elevated brake is provided at a rear of said first compartment, said brake being activatable when a skater lowers said heel portion of said shoe portion of said skate.

17. The multi-directional roller skate as in claim 16 wherein said brake is held in place by an attachment rod, which said attachment rod includes a threaded end, threadable within a threaded receptacle of said compartment.

18. The multi-directional roller skate as in claim 7 further comprising a band brake encircling said skate at a lower end thereof for side movement braking.

19. The multi-directional roller skate as in claim 18 wherein said band brake is elastomeric and removable, said band brake being stretchable around said skate.

* * * * *